US008002148B2

(12) United States Patent
Pakkert et al.

(10) Patent No.: US 8,002,148 B2
(45) Date of Patent: Aug. 23, 2011

(54) DRINK DISPENSER WITH DISPENSING LINE THAT CAN BE HINGED OPEN

(75) Inventors: Engbert Hermannes Pakkert, Delft (NL); Quintijn Innikel, Hilversum (NL)

(73) Assignee: Heineken Supply Chain B.V., Zoetermeer (NL)

( * ) Notice: Subject to any disclaimer, the term of this patent is extended or adjusted under 35 U.S.C. 154(b) by 823 days.

(21) Appl. No.: 10/566,060

(22) PCT Filed: Jul. 15, 2004

(86) PCT No.: PCT/NL2004/000512
§ 371 (c)(1),
(2), (4) Date: Mar. 7, 2008

(87) PCT Pub. No.: WO2005/007559
PCT Pub. Date: Jan. 27, 2005

(65) Prior Publication Data

US 2008/0156828 A1 Jul. 3, 2008

(30) Foreign Application Priority Data

Jul. 21, 2003 (NL) ..... 1023967

(51) Int. Cl.
*B67D 7/80* (2010.01)

(52) U.S. Cl. ..... 222/146.6; 222/183; 222/394; 62/306; 62/398; 62/399; 62/400

(58) Field of Classification Search ..... 222/146.6, 222/173, 183, 373, 399, 146.1; 62/306, 389, 62/398–400
See application file for complete search history.

(56) References Cited

U.S. PATENT DOCUMENTS 735,295 A * 8/1903 Price ..... 62/398
(Continued)

FOREIGN PATENT DOCUMENTS

CH 257821 10/1948
(Continued)

OTHER PUBLICATIONS

WO 2005/007559 A3 (Netherlands), with International Search Report mailed Dec. 1, 2004 by the European Patent Office (EPO) in counterpart international application No. PCT/NL2004/000512, filed Jul. 15, 2004.

(Continued)

*Primary Examiner* — Kevin P Shaver
*Assistant Examiner* — Andrew Bainbridge
(74) *Attorney, Agent, or Firm* — Abelman, Frayne & Schwab

(57) ABSTRACT

The invention relates to a drink dispenser provided with a chamber with an opening for accommodating a container containing carbonated drink. The container is provided with an outlet closed by a shut-off valve and a tap head that during use is connected via a line to the outlet, which tap head has an operating member for opening and closing the line. The line has a relatively stiff line section with a first part and a second part that are in contact with one another in a contact plane extending in a longitudinal direction of the line and which can be taken apart to provide access to an interior surface of the line section. Rubber strips extend in the longitudinal direction of the line section and are arranged in or close to the contact plane to form a liquid barrier. The two line parts have a clamping member that is able to engage on a locking element for fixing the line parts in a position in contact with one another.

20 Claims, 4 Drawing Sheets

U.S. PATENT DOCUMENTS

| | | | | |
|---|---|---|---|---|
| 2,134,852 | A | 11/1938 | Bogan | |
| 3,024,800 | A | 3/1962 | Lewis | |
| 4,204,613 | A * | 5/1980 | Terzian et al. | 222/146.6 |
| 4,402,429 | A | 9/1983 | Vanden Driessche | |
| 4,652,023 | A * | 3/1987 | Timmons | 285/93 |
| 5,129,552 | A * | 7/1992 | Painchaud et al. | 222/146.6 |
| 5,246,140 | A | 9/1993 | Thix et al. | |
| 6,412,668 | B1 | 7/2002 | Vlooswijk et al. | |
| 6,415,963 | B1 | 7/2002 | Vlooswijk et al. | |
| 6,745,922 | B1 | 6/2004 | Vlooswijk et al. | |
| 6,820,775 | B2 | 11/2004 | Meike et al. | |
| 6,824,017 | B2 | 11/2004 | Sluijter | |
| 2002/0050496 | A1 * | 5/2002 | Van Der Meer et al. | 222/105 |
| 2004/0050879 | A1 | 3/2004 | Vlooswijk et al. | |
| 2004/0226967 | A1 * | 11/2004 | Van Der Klaauw et al. | 222/146.6 |

FOREIGN PATENT DOCUMENTS

| | | | |
|---|---|---|---|
| DE | 198 02 291 | A1 | 1/1998 |
| DE | 19802291 | | 8/1999 |
| DE | 201 15 158 | | 2/2002 |
| EP | 1256756 | | 5/2002 |
| EP | 1256756 | | 11/2002 |
| FR | 1 255 526 | | 3/1961 |
| JP | 05 296397 | | 11/1993 |
| NL | 1012922 | | 6/2000 |
| NL | 1019054 | | 9/2001 |
| NL | 1019526 | | 1/2002 |
| NL | 1016688 | | 5/2002 |
| NL | 1019054 | | 3/2003 |
| WO | WO00/03944 | | 1/2000 |
| WO | WO 00/03944 | | 1/2000 |
| WO | WO2005/007560 | | 1/2005 |
| WO | WO2005/012157 | | 2/2005 |

OTHER PUBLICATIONS

International Search Report and Written Opinion, mailed on Nov. 5, 2004, by the European Patent Office in related foreign application No. PCT/NL2004/000514, published as WO 2005/012157.

International Preliminary Report on Patentability, issued Jan. 23, 2006, by the European Patent Office in related foreign application No. PCT/NL2004/000514, published as WO 2005/012157.

International Search Report anfd Written Opinion mailed on Mar. 14, 2005 by European Patent Office in related foreign application No. PCT/NL2004/000513, published as WO 2005/007560.

International Preliminary Report on Patentability, issued Jan. 23, 2006, by the European Patent Office in related foreign application No. PCT/NL2004/000513, published as WO 2005/007560.

International Search Report and Written Opinion mailed Dec. 1, 2004 by the European Patent Office in counterpart European application No. PCT/NL2004/000512, published as WO 2005/007559.

International Preliminary Report on Patentability, issued Jan. 23, 2006, by European Patent Office in counterpart foreign application No. PCT/NL2004/000512, Published as WO 2005/007559.

Patent Abstracts of Japan, vol. 018,090, Feb. 15, 1994 and JP 05 296397.

* cited by examiner

DRINK DISPENSER WITH DISPENSING LINE THAT CAN BE HINGED OPEN

The invention relates to a drink dispenser provided with a chamber with an opening for accommodating a container containing carbonated drink, which container is provided with an outlet closed by a shut-off valve and a tap head that during use is connected via a line to the outlet, which tap head has an operating member for opening and closing the line.

A drink dispenser of this type is disclosed in PCT/NL99/00454. The known dispenser comprises a chill chamber in which a pack containing carbonated drink, such as beer, can be placed. The pack containing carbonated drink comprises an outer container made of plastic and an inner, flexible bag with the carbonated drink therein. The flexible bag is connected via a fill and dispensing head to the neck of the outer container. The dispensing head is provided with a first, relatively wide fill channel to which a filling head of a fill line can be connected for filling the flexible bag. After filling and detaching the filling head from the fill line, the fill channel of the filling and dispensing head is closed by a spring-loaded valve. A second, relatively narrow dispensing channel in the filling and dispensing head is connected to a flexible hose that extends at right angles to the longitudinal direction of the container. Before placing the container in the chill chamber of the drink dispenser, the dispensing channel is likewise closed by means of a spring-loaded valve. A plastic outflow component that is provided with a plate with a brand name thereon is attached at right angles to the end of the flexible hose, which outflow component can be placed in a seat in the dispensing head of the drink dispenser. The dispensing head comprises two parts that are able to hinge, which parts delimit a feed channel for the flexible hose, and a shut-off valve connected to a tap handle. The shut-off valve has a spring-loaded clamping mechanism that can pinch shut and release the flexible hose in the feed channel by operation of the tap handle.

After the flexible hose has been placed in the feed channel, the dispensing head is closed and the tap handle is placed in the closed position. A lid on the dispenser can then be closed and pressure means, such as a compressor, can be connected to the container for feeding a pressure medium into the gap between the wall of the outer container and the flexible bag. When the lid of the chill chamber of the dispenser is closed, the dispensing channel of the filling and dispensing head is opened, so that the contents of the flexible bag are driven into the flexible hose. By opening the tap handle, the flexible hose is released and this assumes its free, undeformed cross-section and the carbonated drink is dispensed from the dispensing head under pressure. The known dispenser is also provided with a chiller, such as a Peltier element, for cooling the drink.

The flexible hose that in the known dispenser connects the container to the tap head is a disposable part for one-off use. The flexible hose is supplied sterile with the pack by the manufacturer and when the container is placed in the dispenser one end of the hose is connected to the dispensing opening in the container and the other end is placed in the tap head. Problems with contaminants that usually arise in a line are solved by the use of the one-off dispensing line, without a cleaning operation being required. However, the use of disposable lines is a relatively expensive solution with which environmental aspects can also arise if the re-use of the disposable line is not optimum. It is therefore an aim of the present invention to provide a drink dispenser with which the dispensing line is suitable for using several times, whilst contamination of the line can be counteracted in a simple manner.

In particular, one aim of the present invention is to provide a drink dispenser and a line therefor that can be cleaned easily and with which reliable drink dispensing of, in particular, carbonated drink is possible.

To this end the drink dispenser according to the invention is characterised in that that line has a relatively stiff line section with a first part and a second part that are in contact with one another in a contact plane extending in a longitudinal direction of the line and which can be taken apart to provide access to an internal surface of the line section, wherein sealing means extending in the longitudinal direction of the line section are arranged in or close to the contact plane to form a liquid barrier and wherein the two line parts have a clamping member that is able to engage on a locking element for fixing the line parts in a position in contact with one another.

During use, the parts of the rigid line section are clamped against one another in a closed manner by the locking element, which can be part of a lid of the chill chamber or which can be a separate locking element, such as a clamp closure or a screw connector. In order to clean the line, in one embodiment this is removed from the chill chamber and the line parts are taken apart in the longitudinal direction so that the interior of the line becomes accessible. Both line parts can then be cleaned, for example in a dishwasher or by hand using a cleaning fluid. The line parts are then placed with their contact surfaces against one another, such that the sealing means of both line parts form a liquid-tight seal. One end of the line is then connected to the tap head and the other end to the outlet of the container and a liquid-tight clamping force is exerted on both halves via the locking element. Using the relatively rigid line according to the invention multiple use can take place in a simple manner, whilst as a result of the construction that can be cleaned easily the shelf life of the drink dispensed from the container, which in particular can be beer, is prolonged.

In one embodiment the line parts are joined to one another by a hinge running in the longitudinal direction. With this arrangement the line parts can be simply hinged open without them coming apart or coming away from the chamber and after cleaning can be brought back via the hinge into the correct sealing position in which they are in contact with one another.

In a further embodiment of a drink dispenser according to the invention, the container is provided with an accommodating opening at the top and with a lid for closing off the opening, the lid having an accommodating slot for accommodating the line section with an essentially cylindrical central accommodating portion and, as locking element, two slot-shaped accommodating portions, on either side of the central accommodating portion.

The rigid line section with a protruding flange on either side can be pushed into the accommodating opening in the lid of the container so that this part is accommodated with a tight fit and with this arrangement an adequate clamping force is exerted on the halves of the lines by the accommodating opening so as to obtain a liquid-tight seal. The line can easily be removed by sliding this out of the slot, for example in that the line is provided at the outflow end thereof with gripping means such as a lip or ring.

In a further embodiment the dispenser is provided with an outflow end located transversely to the relatively rigid line section, with a shut-off valve that during use interacts with the dispensing head and that can be opened and closed by operating the dispensing head.

The outflow end can have a ball valve that can interact with the dispensing head. The dispensing head can, for example, have an operating arm that can operate a pin that can be moved up and down in the outflow end in order to move a ball valve. Provision is also made that the dispensing head has magnetic means that, via a magnetic field, can move a ball valve accommodated in the outflow end between a release position and closed position.

In a further embodiment the line is U-shaped, where not only the outflow end but also an inflow end is located transversely to the rigid line section. The inflow end can be brought into engagement with the shut-off valve of the container, for example by closing the lid, as a result of which the line is moved downwards and is able to open the spring-loaded shut-off valve of the container.

In a further embodiment the rigid line section comprises a heat exchanger, the line section being provided with heat transfer members located along loops for extracting heat from the line section. By moving the line parts apart, the interior of the heat exchanger becomes accessible for cleaning. In view of the relatively long length of the loops a construction that can easily be opened for cleaning is a major advantage. In this case when the line parts are opened these can remain attached to the chill chamber, for example because they are joined to one another via a hinge construction.

A few embodiments of a drink dispenser and line for use therein according to the present invention will be explained in more detail by way of example with reference to the appended drawing. In the drawing:

FIG. 1 shows a diagrammatic longitudinal section of a chill chamber with a container according to the present invention therein;

FIGS. 2*a* and 2*b* show a cross-section of a line for use in the dispenser according to FIG. 1 in an open position and a closed position, respectively;

Figure 1:
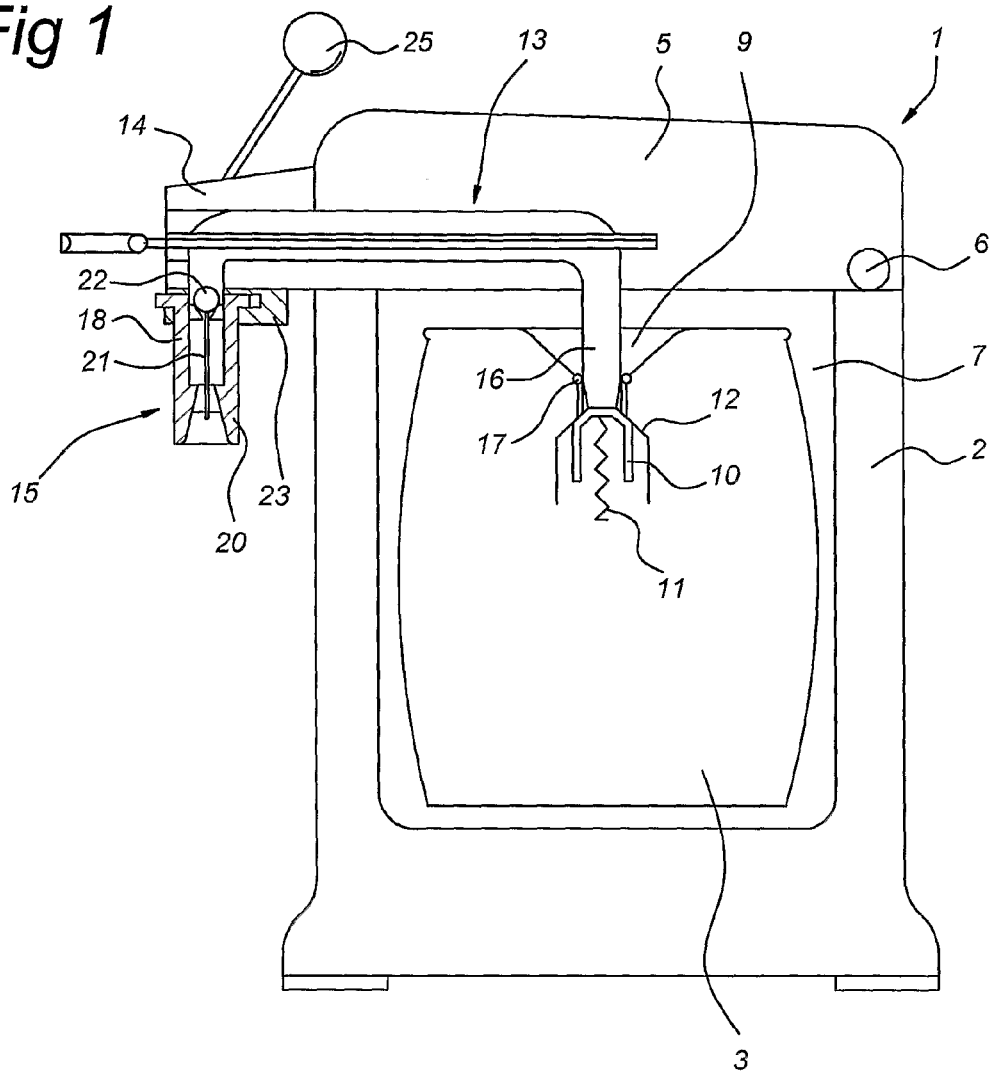

FIG. 1 shows a drink dispenser 1 according to the present invention provided with a chamber, such as a chill chamber 2, for accommodating a container 3 with a carbonated drink therein, such as, for example, beer. Such a dispenser and container are described in detail in NL 1019054 and in PCT/NL99/00454, both in the name of the Applicant. The chill chamber 2 is provided with a lid 5 that is attached to a side wall of the chill chamber 2 at a hinge point 6 such that it can hinge. When the lid 5 is in the hinged open position the container 3 can be placed in the chill space 7 through the opening in the top surface of the chill chamber 2. During this operation an outlet 9 of the container 3 is closed off by a shut-off valve 10 that is pushed by a spring 11 against a shoulder 12 of outlet 9. A line 13 is then fitted in the lid 5 in such a way that an outflow end 15 is connected to a tap head 14 and an inflow end 16 of the line 13 is introduced into the outlet 9 of the container 3 when the lid 5 is in a closed position and pushes the shut-off valve 10 down against the spring pressure of spring 11. As a result the contents of the container 3 come into contact with a shut-off valve 18 in the line 13. Via a seal 17, such as an O-ring, the contents of the container 3 are prevented from flowing into the chamber 7 past the inflow end 16 of the line 13.

The outflow end 15 of the line 13 has, as shut-off valve, a movable sleeve 20 with a plunger 21 and a ball valve 22 therein, the ball of which ball valve is able to move up and down relative to a seat in the channel 13. The sleeve 20 is operated via an operating fork 23 that is attached to the dispensing head 14 such that, by operation of a handle 25 by the user, it can move up and down and in this way displaces the sleeve 20 and moves the ball 22 up and down for dispensing beer from the container 3.

Figure 2A:
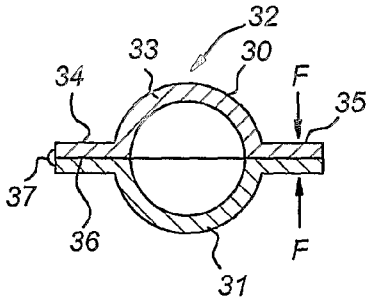
Figure 2B:
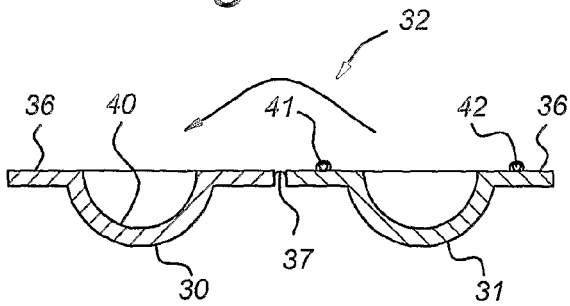

FIG. 2*a* shows a cross-section of the central line section 32 of the line 13 with a first line part 30 and a second line part 31. The line parts 30, 31 have a cylindrical central portion 33 and two flanges 34, 35. The parts 30, 31 are in contact with one another in a contact plane 36. A liquid-tight seal is obtained by exerting a compressive force on the flanges in the direction of the arrow F. FIG. 2*b* shows the central line section 32 in the position in which it has been folded up by hinging open the parts 30, 31 about the hinge 37. By this means the internal surface 40 of the central line part 30 is exposed and becomes accessible for cleaning, for example by means of a dishwasher or manually using a cleaning agent. Sealing means 41, 42, such as, for example, rubber strips, can be fitted on the flanges 34, 35 of the part 31 of the rigid line section 32. By this means a liquid-tight barrier is obtained and liquid is prevented from leaking outwards from the central part 30 along the contact plane 36.

Figure 3:
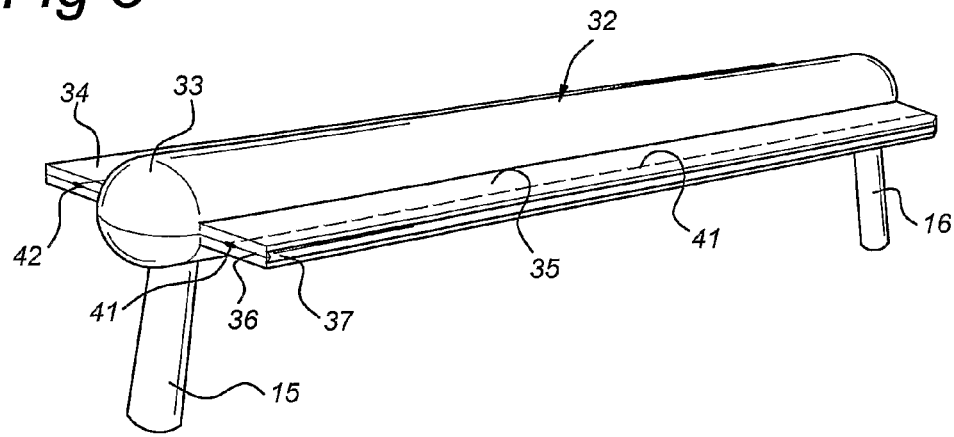
FIG. 3 shows a perspective view of a line according to FIG. 2 in the closed position.

FIG. 3 shows a perspective view of the line 13 with the relatively rigid line section 32, the outflow end 15 and the inflow end 16.

Figure 4:
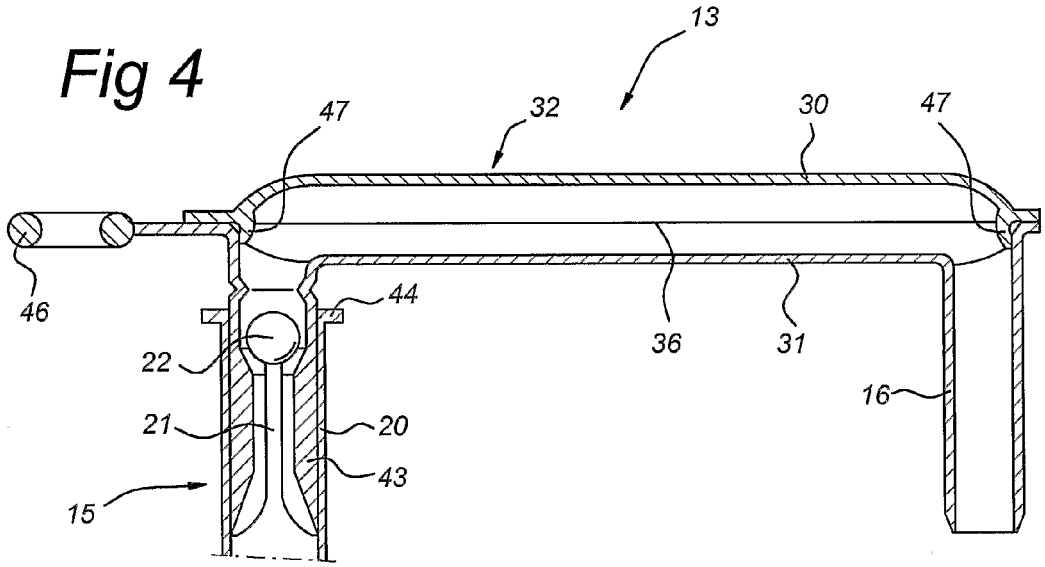
FIG. 4 shows a cross-section in the longitudinal direction of the line according to FIG. 3.

FIG. 4 shows a longitudinal section on an enlarged scale of the line 13 with central line section 32, outflow end 15 and inflow end 16. The construction of the sleeve 20 that can slide around the line section 43 made of relatively stiff plastic can clearly be seen. The sleeve 20 has a flange 44 at the top thereof, which flange engages on the operating fork 23 that can be moved up and down along the chill chamber 2 with the aid of the handle 25. At its top end the line section 32 is provided with a pull lip or ring 46 to detach the line section 32 from engagement means fixed to the lid 5 of the chill chamber 2. A lip seal 47 is fitted on the internal surface of the line part 30 to guarantee a liquid-tight seal along the contact plane 36.

By moving the sleeve 20 up and down the ball 22 can be lifted from its seat to open the line 32 or can be lowered onto the seat to close off said line. With this arrangement there is a minimum number of components in the outflow end 15, which can also be cleaned easily, optionally by sliding the sleeve 20 off the pipe section 43 and cleaning the outside of the plunger 21 from the outflow channel.

Figure 5:
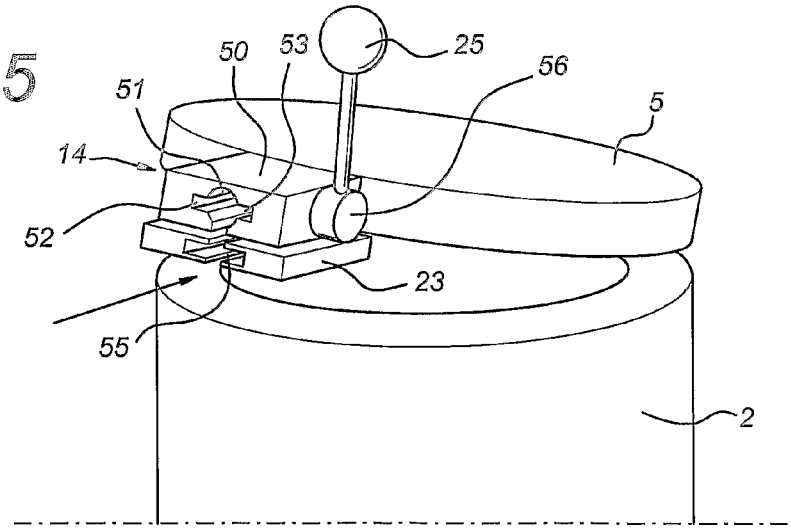
FIG. 5 shows a perspective view of a tap head and locking element according to the present invention.
Figure 6:
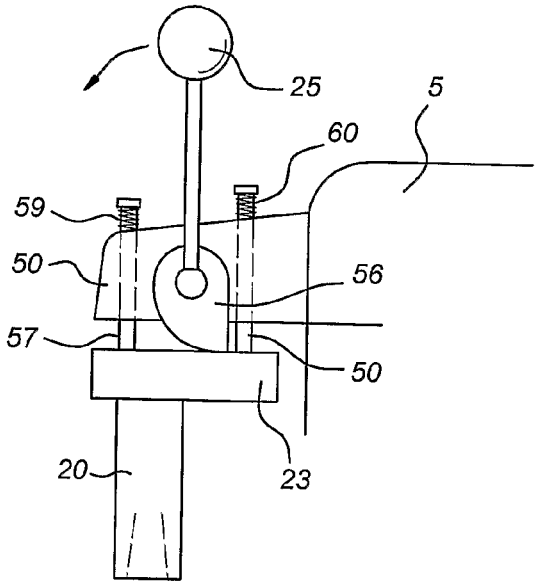
FIG. 6 shows the operating member of the tap head according to the invention in detail.

FIG. 5 shows a perspective view of the dispensing head 14, attached to the lid 5 of the chamber 2. The tap head 14 comprises a clamping block 50 with a cylindrical central portion 51 and two accommodating slots 52, 53 for accommodating the flanges 34, 35 of the line section 32. By introducing the line section 32 into the clamping block 50 the flanges 34, 35 are pressed together tightly closed, so that a liquid-tight seal is obtained. Furthermore, the flange 44 of the sleeve 20 is introduced into a slot 55 in the operating fork 23. The operating fork 23 can be moved up and down by means of the handle 25 that is connected to a cam 56. This can be seen more clearly from FIG. 6, from which it can be seen that the operating fork 23 is mounted on two guide pins 57, 58 that bear on the clamping block 50 via springs 59, 60. Movement of the handle 25 in the direction of the arrow results in the operating fork 23 moving upwards as a result of expansion of the springs 59, 60, so that the ball 22 (see FIG. 4) in the outflow section 15 of the line 13 is lifted up and drink is dispensed from the container 3. When the handle 25 is in the upright position, the cam 26 pushes the operating fork 23 downwards against the spring pressure of springs 59, 60, so that the sleeve 20 is placed in its lowermost position and the ball 22 rests on the valve seat under the influence of gravity and forms a liquid-tight seal.

Figure 7:
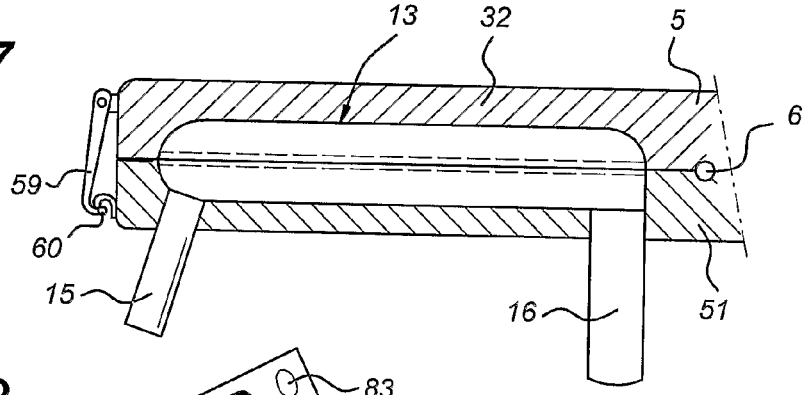
FIG. 7 shows a longitudinal section of an alternative locking element according to the invention.

FIG. 7 shows an alternative embodiment in which the line 13 is enclosed between the lid 5 and a lower lid part 5' of the chamber 2, the parts 5, 5' being clamped against one another by a locking element in the form of a hinged catch 59 on the lid 5 and a hook member 60 on the lower part 5' of the lid.

Figure 8:
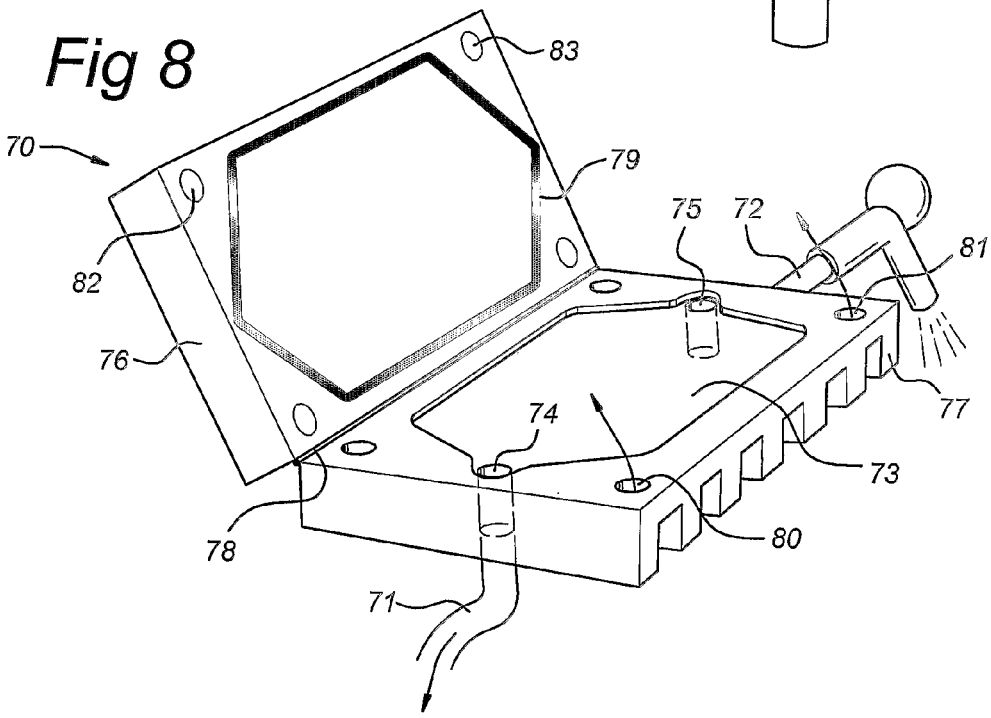
FIGS. 8-10 show perspective views of a heat exchanger according to the invention.

FIG. 8 shows a heat exchanger 70 that forms part of the beer line with an inflow end 71 that is connected to the container 3 and an outflow end 72 for dispensing beer. The inflow line 71 opens into a chill chamber 73 via feed opening 74. The chilled liquid, which because of the relatively large volume of the chamber 73 has a relatively longer residence time therein, can be dispensed in chilled form at the outflow end 72 via discharge opening 75. The part 76 of the heat exchanger 70 is joined via a hinge 78 to the part 77 and can be placed in the closed position. With this arrangement a seal 79, such as an elastic ring, surrounds the chamber 73 to provide a liquid-tight seal. Liquid-tight joining of the parts 76, 77 can be obtained via screws 80, 81 that interact with threaded openings 82, 83 in the heat exchanger part 76, whilst the said parts 76, 77 can easily be removed in order to clean the interior of the chamber 73.

Figure 9:
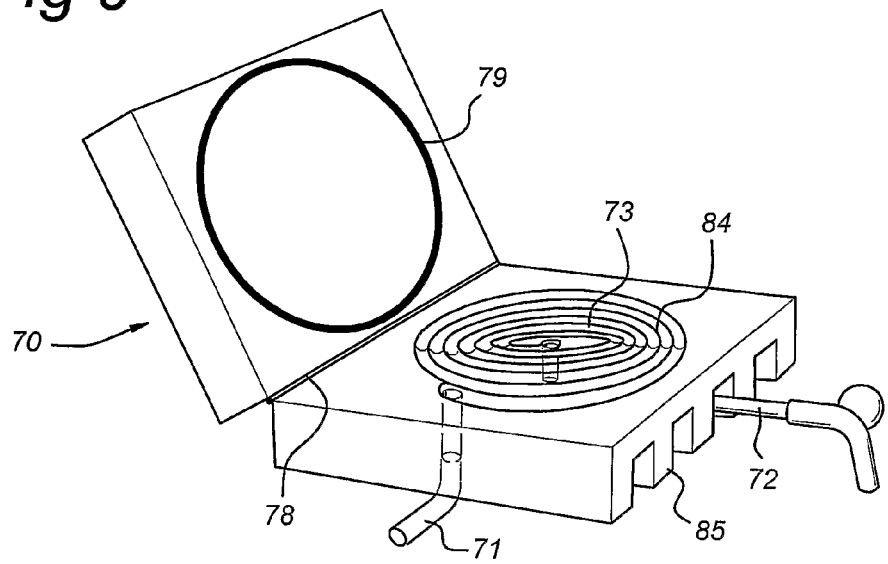

FIG. 9 shows an embodiment in which the heat exchanger 70 is provided with a number of cooling ribs 84 in spiral form in the chamber 73 for effective heat exchange. The heat exchanger 70 can be cooled, for example by means of water or air via cooling ribs 85 or can be connected to a Peltier cooling element for electrical cooling.

Figure 10:
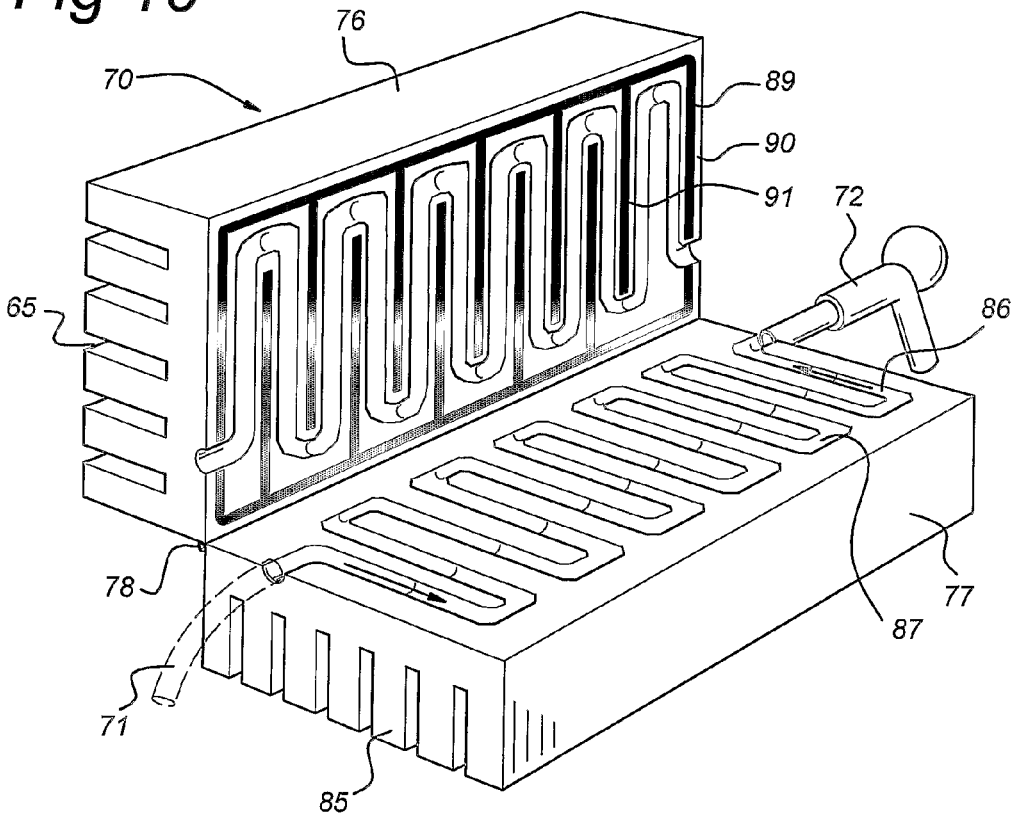

Finally, FIG. 10 shows an alternative embodiment of a heat exchanger 70 where the cooling channel comprises a number of loops 86, 87, where the seal 89 made of flexible material, such as, for example, rubber or silicones, comprises a number of fingers 90, 91 located between the loops 86, 87 for a liquid-tight seal. By means of the cooling element 70 rapid in-line cooling of drink can be obtained when this flows from the chamber 2 to the outflow end 72. As a result, the chamber 2 itself does not have to be cooled, or relatively little cooling of the chamber 2 can suffice since most cooling takes place by means of the heat exchanger 70. Because of the complex internal structure of the heat exchanger 70, frequent cleaning is very important for the shelf life of the drink, especially if this consists of beer. By hinging open the parts 76, 77 about the hinge 78, the interior of the heat exchanger can be made accessible in a simple manner in order to clean this. For this purpose the heat exchanger 70 can be removed from the chamber 2 and can be placed in a dishwasher or other cleaning installations or can be cleaned manually. Alternatively, the heat exchanger 70 remains attached to the chamber 2 during cleaning thereof. Fixing of the parts 76, 77 can once again be effected by means of screws as shown in FIG. 8, but can also be effected via clamping in the lid of the dispenser or in some other way.

The invention claimed is:

1. Drink dispenser (1) provided with a chamber (2) with an opening for accommodating a container (3) containing carbonated drink, and with a lid (5) for closing off the opening, which container is provided with an outlet closed by a shut-off valve (10), a tap head (14) that during use is connected via a line (13) to the outlet (9), which tap head has an operating member (23,25) for opening and closing the line, the line (13) being releasably engageable between the outlet and the tap head (14) to provide a fluid connection therebetween, characterised in that the line has a relatively stiff line section (32,70) with a first part (30,76) and a second part (31,77) that are in contact with one another in a contact plane extending in a longitudinal direction of the line and which can be taken apart to provide access to an internal surface of the line section, wherein sealing means (41,42, 47, 79,90,91) extending in the longitudinal direction of the line section are arranged in or close to the contact plane to form a liquid barrier and wherein the two line parts have a clamping member (34,35, 80,81) that is able to engage on a locking element (51,52, 53, 59,60, 82,83) for fixing the line parts (30,31, 76,77) in a position in contact with one another, the lid (5) having an accommodating slot (51, 52, 53) for accommodating the line section (32) with an essentially cylindrical central accommodating portion (51) and, as the locking element, a generally slot-shaped accommodating portion (52,53) on either side of the central accommodating portion (51).

2. Drink dispenser (1) according to claim 1, wherein the line parts are joined to one another by a hinge (37, 78) running in the longitudinal direction.

3. Drink dispenser (1) according to claim 1, wherein the clamping member comprises a respective flange (34,35) joined to each line part.

4. Drink dispenser (1) according to claim 1, wherein the line (13) has an outflow end (15) oriented generally transversely to the relatively stiff line section (32), with a shut-off valve (18) that during use interacts with the dispensing head (14) and that can be opened and closed by operating the dispensing head (14).

5. Drink dispenser (1) according to claim 1, wherein the line (13) has an inflow end (16) that is located transversely to the relatively stiff line section (32) and in use engages on the shut-off valve (10) of the container (3).

6. Drink dispenser (1) according to claim 1, wherein the line section (32) close to the outflow side is provided with gripping means (46).

7. Drink dispenser (1) according to claim 1, wherein the line section (32) comprises a cooling member (70).

8. Drink dispenser (1) according to claim 7, wherein the cooling member (70) has a number of loops (86,87) that extend transversely to the longitudinal direction of the line section and wherein the line section is provided with heat transfer members (76,77, 85) located along the loops for extracting heat from the line section.

9. Line (13) for use in a drink dispenser (1) according to claim 1, comprising a relatively stiff line section (32,70) with a first part (30,76) and a second part (31,77) which can be taken apart in the longitudinal direction of the line to provide access to an internal surface (40) of the line section (32,70), wherein the first and the second line part are in contact with one another in a contact plane (36) running in the longitudinal direction, and wherein sealing means (41,42, 47,79, 90,91) extending in the longitudinal direction of the line section are arranged in or close to the contact plane to form a liquid barrier from the line section and wherein the two line parts have as a clamping member (34, 35, 80, 81) a respective flange (34,35) joined to each line part that is able to engage on the slot-shaped accommodating portions (52, 53) for fixing the line parts (30,31, 76,77) in a position in contact with one another.

10. Drink dispenser (1) according to claim 2, wherein the clamping member comprises a respective flange (34,35) joined to each line part.

11. Drink dispenser (1) according to claim 2, wherein, the line (13) has an outflow end (15) oriented generally transversely to the relatively stiff line section (32), with a shut-off valve (18) that during use interacts with the dispensing head (14) and that can be opened and closed by operating the dispensing head (14).

12. Drink dispenser (1) according to claim 3, wherein the line (13) has an outflow end (15) oriented generally transversely to the relatively stiff line section (32), with a shut-off valve (18) that during use interacts with the dispensing head (14) and that can be opened and closed by operating the dispensing head (14).

13. Drink dispenser (1) according to claim 1, wherein the line (13) has an outflow end (15) oriented generally transversely to the relatively stiff line section (32), with a shut-off valve (18) that during use interacts with the dispensing head (14) and that can be opened and closed by operating the dispensing head (14).

14. Drink dispenser (1) according to claim 1, wherein the line (13) has an inflow end (16) that is oriented generally transversely to the relatively stiff line section (32) and in use engages on the shut-off valve (10) of the container (3).

15. Drink dispenser (1) according to claim 2, wherein the line section (32) close to the outflow side is provided with gripping means (46).

16. Drink dispenser (1) according to claim 2, wherein the line section (32) comprises a cooling member (70).

17. Line (13) for use in a drink dispenser (1) according to claim 2, comprising a relatively stiff line section (32,70) with a first part (30,76) and a second part (31,77) which can be taken apart in the longitudinal direction of the line to provide access to an internal surface (40) of the line section (32,70), wherein the first and the second line part are in contact with one another in a contact plane (36) running in the longitudinal direction, and wherein sealing means (41,42, 47,79, 90,91) extending in the longitudinal direction of the line section are arranged in or close to the contact plane to form a liquid barrier from the line section and wherein the two line parts have as a clamping member (34, 35, 80, 81) a respective flange (34,35) joined to each line part that is able to engage on the slot-shaped accommodating portions (52,53) for fixing the line parts (30,31, 76,77) in a position in contact with one another.

18. Drink dispenser provided with a chamber with an accommodating opening at the top for accommodating a container containing carbonated drink, and with a lid for closing off the opening, which container is provided with an outlet closed by a shut-off valve, a tap head that during use is connected via a line to the outlet, which tap head has an operating member for opening and closing the line, the line being releasably engageable between the outlet and the tap head to provide a fluid connection therebetween, characterised in that the line has a relatively stiff line section with a first part and a second part that are in contact with one another in a contact plane extending in a longitudinal direction of the line and which can be taken apart to provide access to an internal surface of the line section, wherein sealing means extending in the longitudinal direction of the line section are arranged in or close to the contact plane to form a liquid barrier and wherein the two line parts have a clamping member that is able to engage on a locking element for fixing the line parts in a position in contact with one another, the lid having an opening for accommodating the line section, said opening having a generally cylindrical central accommodating portion and, as a locking element, an accommodating opening on either side of the central accommodating opening.

19. Drink dispenser provided with a chamber with an opening at the top for accommodating a container containing carbonated drink, and with a lid for closing off the opening, which container is provided with an outlet closed by a shut-off valve, a tap head that during use is connected via a line to the outlet, which tap head has an operating member for opening and closing the line, the line being releasably engageable between the outlet and the tap head to provide a fluid connection therebetween, characterised in that the line has a relatively stiff section with a first part and a second part that are in contact with one another in a contact plane extending in a longitudinal direction of the line and which can be taken apart to provide access to an internal surface of the line section, wherein sealing means extending in the longitudinal direction of the line section are arranged in or close to the contact plane to form a liquid barrier and wherein the two line parts have a clamping member that is able to engage on a locking element for fixing the line parts in a position in contact with one another, the lid having an opening for accommodating the line section, said opening having a generally cylindrical central accommodating portion and, as a locking element, an accommodating opening on either side of the central opening.

20. Drink dispenser according to claim 19, wherein the line section (32) comprises a cooling member (70).

* * * * *